US008702445B2

(12) United States Patent
Yu et al.

(10) Patent No.: US 8,702,445 B2
(45) Date of Patent: Apr. 22, 2014

(54) ELECTRICAL CONNECTOR

(75) Inventors: Wang-I Yu, Jhonghe (TW); Zhi-Qiang Rong, Taicang (TW); Li-Li Liang, Taicang (TW); Hung-Chi Tai, Jhonghe (TW)

(73) Assignee: Alltop Electronics (Suzhou) Ltd., Taicang, JiangSu Province (CN)

( * ) Notice: Subject to any disclaimer, the term of this patent is extended or adjusted under 35 U.S.C. 154(b) by 0 days.

(21) Appl. No.: 13/477,563

(22) Filed: May 22, 2012

(65) Prior Publication Data

US 2013/0252468 A1 Sep. 26, 2013

(30) Foreign Application Priority Data

Mar. 26, 2012 (CN) ..... 2012 1 0081175

(51) Int. Cl.
*H01R 13/00* (2006.01)

(52) U.S. Cl.
USPC ..... 439/485; 439/626

(58) Field of Classification Search
USPC ..... 439/626, 485
See application file for complete search history.

(56) References Cited

U.S. PATENT DOCUMENTS

| | | | | |
|---|---|---|---|---|
| 7,666,025 | B2 * | 2/2010 | Cheng et al. | 439/485 |
| 8,177,579 | B2 * | 5/2012 | Tai et al. | 439/485 |
| 8,366,458 | B2 * | 2/2013 | Ngo et al. | 439/79 |
| 2006/0035521 | A1 * | 2/2006 | Ngo et al. | 439/608 |
| 2006/0228948 | A1 * | 10/2006 | Swain et al. | 439/660 |
| 2010/0041266 | A1 * | 2/2010 | Data et al. | 439/358 |
| 2010/0184339 | A1 * | 7/2010 | Ngo et al. | 439/682 |
| 2011/0287658 | A1 * | 11/2011 | Yu et al. | 439/485 |

* cited by examiner

*Primary Examiner* — Briggitte R Hammond
(74) *Attorney, Agent, or Firm* — Sughrue Mion, PLLC

(57) ABSTRACT

An electrical connector for mounting onto a printed circuit board includes an insulating housing and a plurality of power contacts. The insulating housing has a number of dividing walls and a number of receiving passageways defined between the dividing walls. The plurality of power contacts is received in the corresponding receiving passageways, respectively. One of the dividing walls defines a heat dissipation cutout thereon for heat dissipation purpose.

13 Claims, 6 Drawing Sheets

ELECTRICAL CONNECTOR

BACKGROUND OF THE INVENTION

1. Field of the Invention

The present invention relates to an electrical connector, and more particularly to an electrical connector mountable onto a printed circuit board.

2. Description of Related Art

Generally, a conventional power connector includes an insulating housing and a plurality of power contacts received in the insulating housing. With the development of the industry, large current is more desired to be used in the electrical devices, which in turn, the design issue of how to dissipate such a large amount of heat needs to confront. In the meanwhile, changing of the power contact of the connector is also another design issue needed to be cared.

Hence, an electrical connector with improved structure to settle above-described design issues is desired.

BRIEF SUMMARY OF THE INVENTION

The present invention provides an electrical connector for mounting onto a printed circuit board. The electrical connector includes an insulating housing and a plurality of power contacts. The insulating housing has a number of dividing walls and a number of receiving passageways defined between the dividing walls. The plurality of power contacts are received in the corresponding receiving passageways, respectively. One of the dividing walls defines a heat dissipation cutout thereon for heat dissipation purpose.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
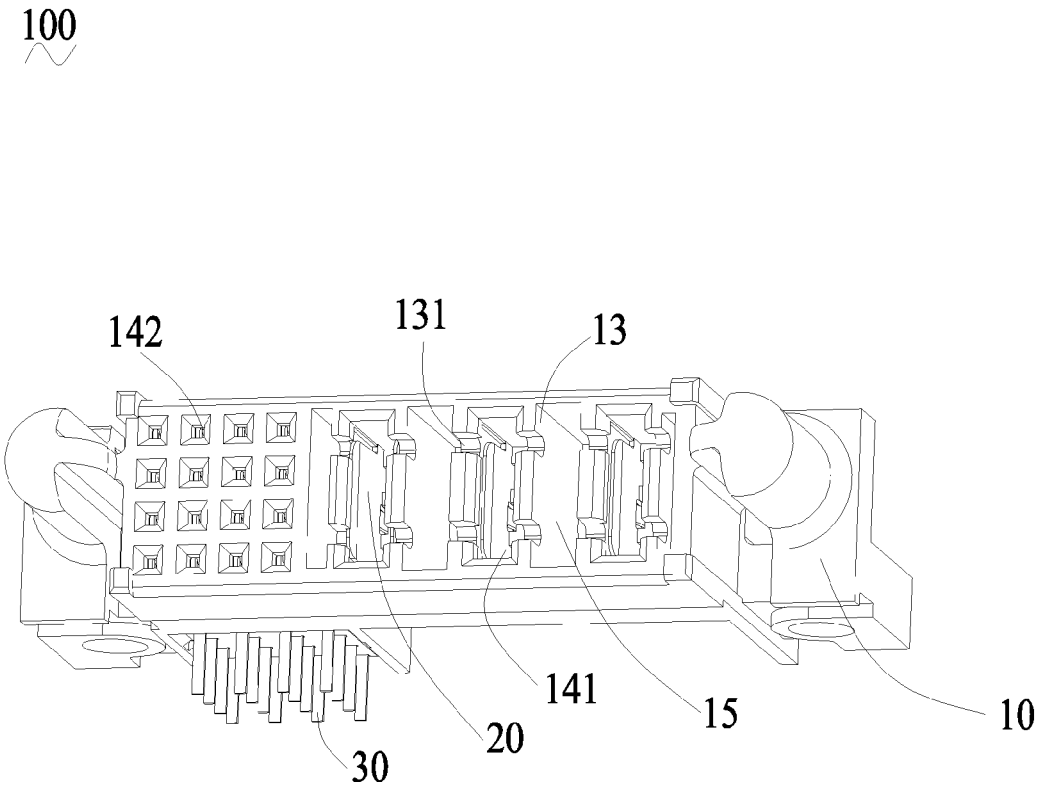
FIG. 1 is a perspective view of an electrical connector in accordance with the present invention.

Reference will now be made to the drawing figures to describe the embodiments of the present invention in detail.

In the following description, the same drawing reference numerals are used for the same elements in different drawings.

Figure 2:
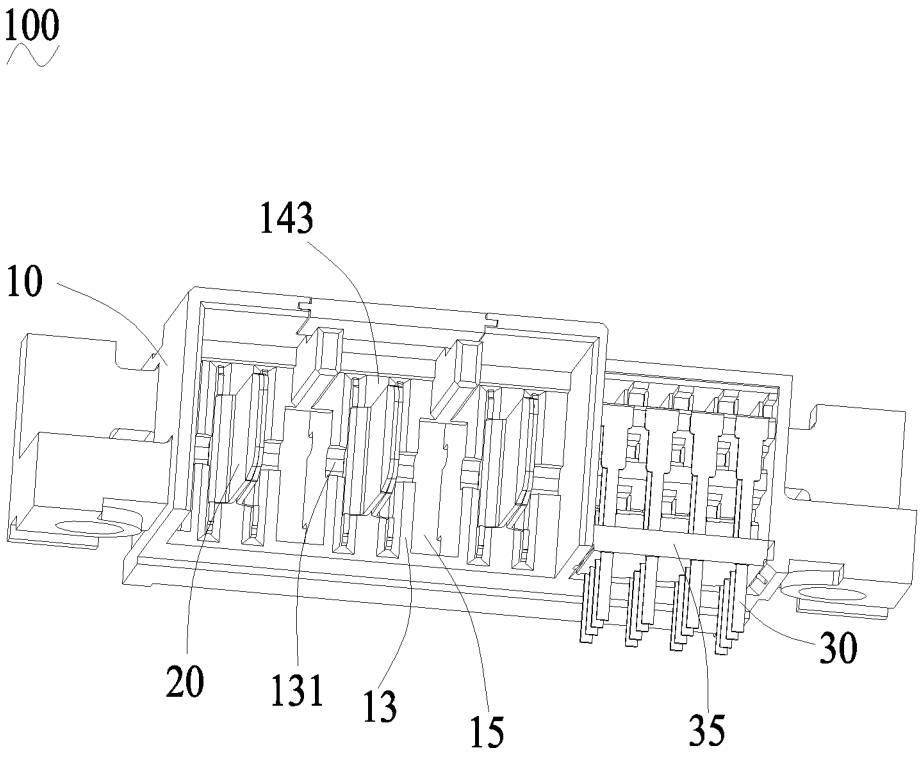
FIG. 2 is a perspective view similar to FIG. 1 while taken from another aspect.
Figure 3:
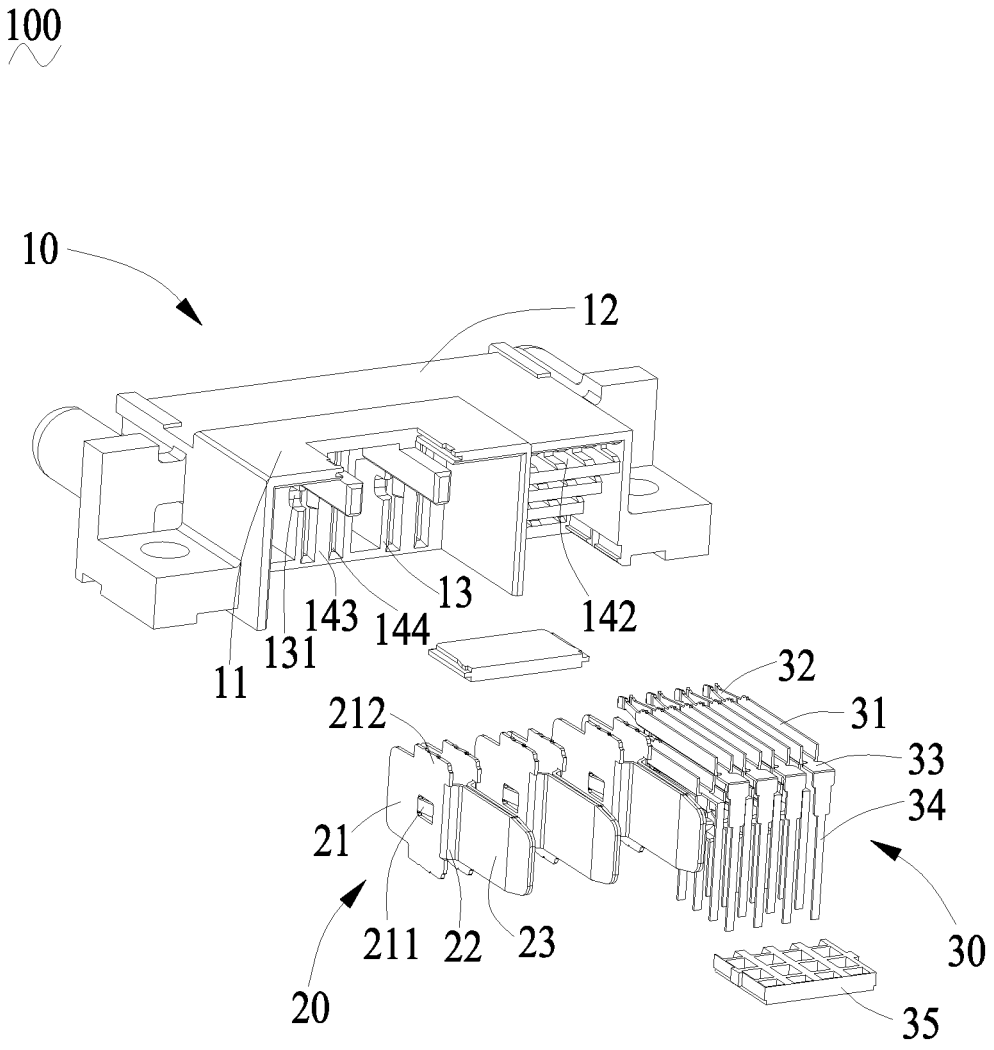
FIG. 3 is an exploded perspective view of the electrical connector.

Referring to FIGS. 1-3, an electrical connector 100 in accordance with the present invention, which is mountable to a printed circuit board (not shown), comprises an insulating housing 10, a plurality of power contacts 20 assembled in the insulating housing 10, and a plurality of signal contacts 30 assembled to the insulating housing 10 for transmitting signals. In the preferred embodiment, the plurality of power contacts is arranged in pairs.

Figure 4:
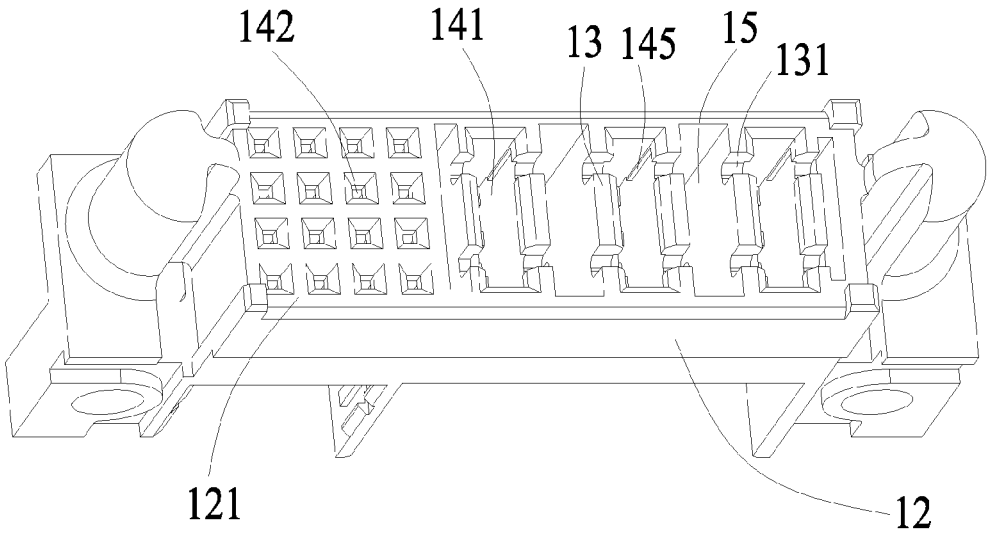
FIG. 4 is a perspective view of an insulating housing of the electrical connector.
Figure 5:
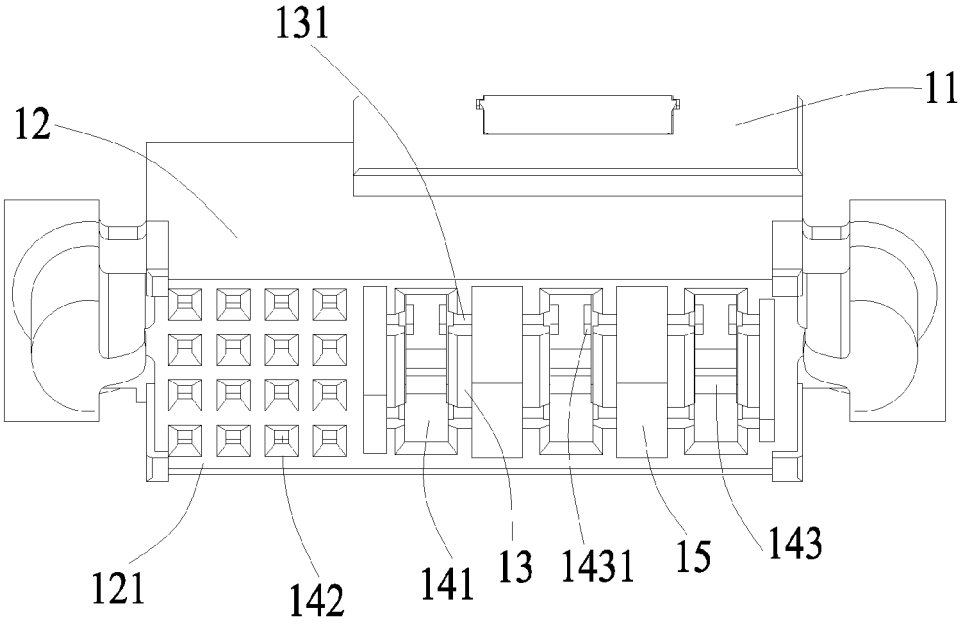
FIG. 5 is a perspective view similar to FIG. 4 while taken from another aspect.
Figure 6:
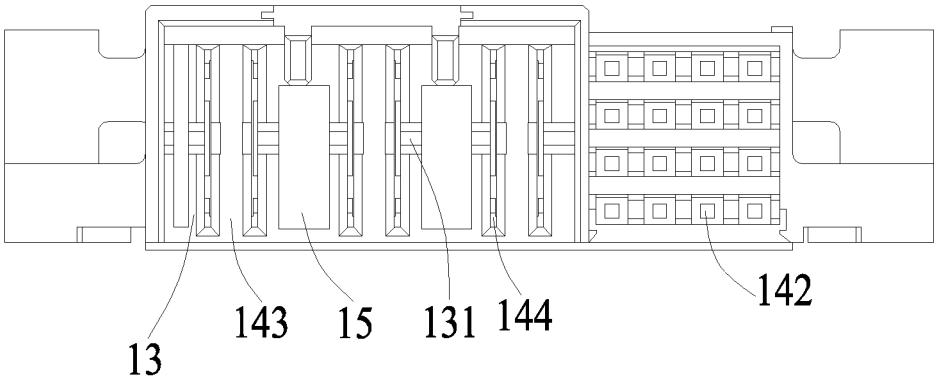
FIG. 6 is a front view of the insulating housing of the electrical connector.

Referring together to FIGS. 4-6, the insulating housing 10 comprises a main section 11 and a mating section 12 extending forwardly from the main section 11. The mating section 12 provides a mating surface 121 in the front thereof for mating to a complementary connector (not shown). The insulating housing 10 forms a plurality of dividing walls 13 and defines a plurality of first receiving passageways 141 and second receiving passageways 142 between the dividing walls 13. In the preferred embodiment, the first receiving passageways 141 are provided to receive the power contacts 20, and the second receiving passageways 142 are provided to receive the signal contacts 30. In the preferred embodiment, the configurations of the power contact 20 and the signal contact 30 are different from each other. Correspondingly, the configurations of corresponding first passageway 141 and corresponding second passageway 142 are also different from each other. Understandably, in some applications, the configurations of the power contact 20 and the signal contacts 30 can be the same. The insulating housing 10 also has guiding posts (not labeled) formed on the main section 11 and at opposite sides of the mating section 12.

The first receiving passageway 141 is provided with a back wall 143 extending along a height direction of the electrical connector 100. The back wall 143 defines a pair of recesses 1431. A pair of back slits 144 is defined through the back wall 143 and communicates with the corresponding first receiving passageway 141. The pair of power contacts 20, which is received in the same receiving passageway 141, is inserted into and secured within the insulating housing 10 through the pair of back slits 144. Displacements of the power contacts 20 along the height direction, the width direction and the lengthwise direction of the electrical connector 100, are therefore limited. Each first receiving passageway 141 defines a plurality of receiving slots 145 in inside walls thereof.

The dividing wall 13 defines a heat dissipation cutout 131 recessed from the mating surface 121 of the insulating housing 10. In the preferred embodiment, the heat dissipation cutout 131 has a U-shaped cross-section. The insulating housing 10 also defines a plurality of openings 15 between each two adjacent first receiving passageways 141. The opening 15 communicates with the corresponding heat dissipation cutout 131. The heat generated from the inside of the electrical connector 100 can be dissipated through the openings 15 and the heat dissipation cutouts 131.

Figure 7:
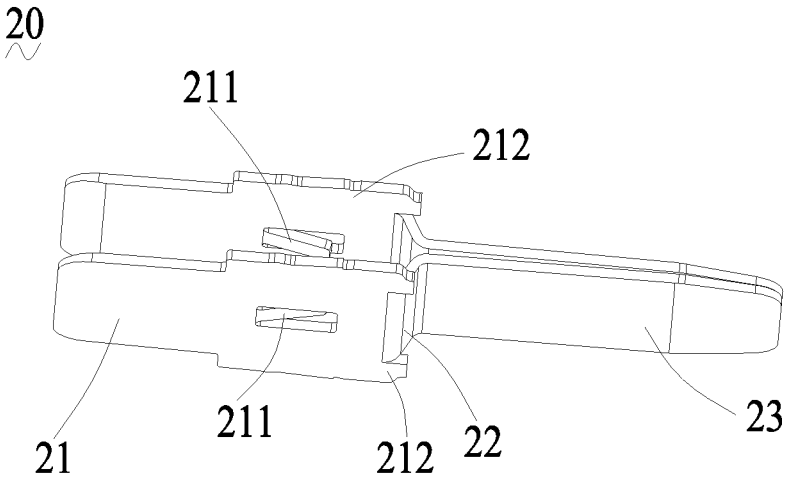
FIG. 7 is a perspective view of a pair of power contacts of the electrical connector.

Referring to FIG. 7, each power contact 20 comprises a base portion 21, a contacting portion 23 extending from the base portion 21 and a bent portion 22 connecting the contacting portion 23 and the base portion 21. Each pair of power contacts 20, which is received in the same receiving passageway 141, is arranged in mirror symmetry. Each base portion 21 of the pair of power contacts 20 forms a tab 211 protruded along a front-to-back direction. The two tabs 211 of the pair of power contacts 20 extend towards each other. Each base portion also provides a barb 212 along the two side edges thereof for retaining the power contacts 20 in the corresponding first passageway 141. Engagements between the tab 211 and the recess 1431 and between the barb 212 and the receiving slot 145 limit the undesired movements of the power contact 20 along the height direction, the width direction and the lengthwise direction of the electrical connector 100. Obviously, the power contact 20 is firmly secured in the insulating housing 10.

Figure 8:
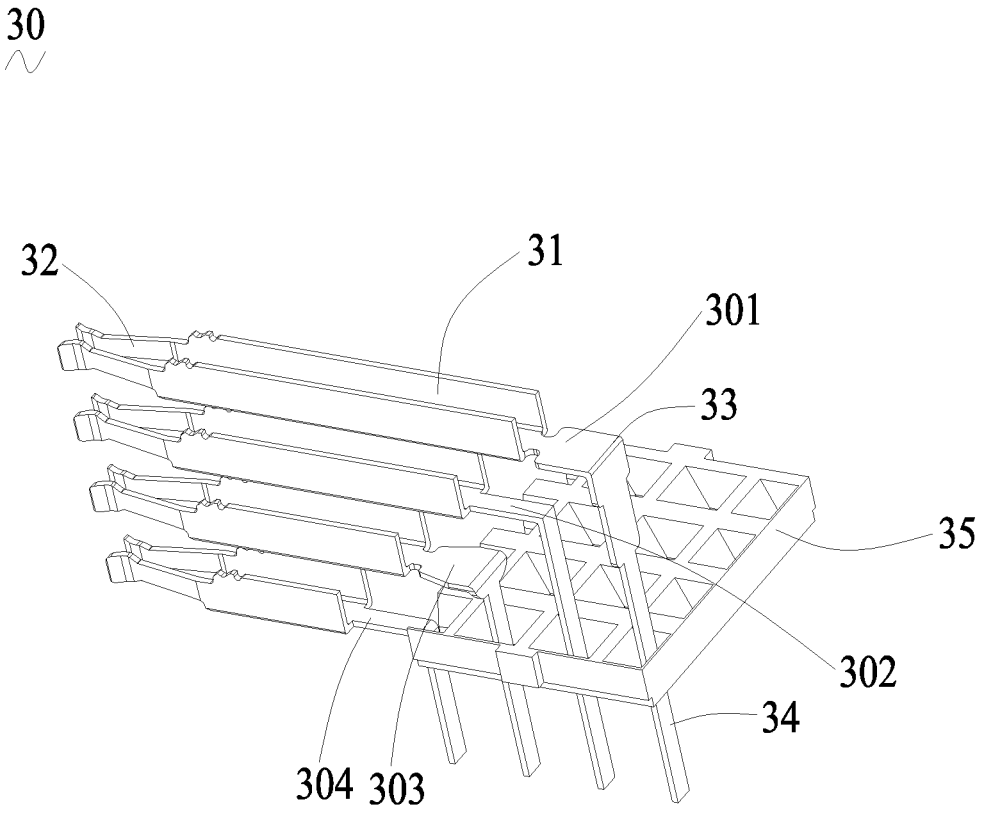
FIG. 8 is a schematic, perspective view of signal contacts and spacer of the electrical connector.

Referring to FIG. 8 together with FIG. 2, the plurality of signal contacts 30 are received in the corresponding second receiving passageways 142. Each signal contact 30 comprises a retaining portion 31, a contacting end 32 protruding from the retaining portion 31, a tail portion 34 extending from the retaining portion 31 opposite to the contacting end 32, and a bent portion 33 connecting the retaining portion 31 and the tail portion 34. The bent portion 33 is configured approximately to be perpendicular to the retaining portion 31. In the preferred embodiment, the electrical connector 100 further comprises a spacer 35 for guiding and securing the tail portions 34 of the plurality of signal contacts 30. The spacer 35 facilitates the reliable insertions of the tail portions 34 to holes of the printed circuit board. The plurality of signal contacts 30 includes a first group of signal contacts 301, a second group of signal contacts 302, a third group of signal contacts 303 and a fourth group of signal contacts 304. The tail portions 34 of the different groups of the signal contacts 30 are located in different rows along a front-to-back direction of the electrical connector 100. In the preferred embodiment, the bent portions 33 of the second group of the signal contacts 302 and the fourth group of the signal contacts 304 are the same.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for mounting onto a printed circuit board, comprising:

an insulating housing having a plurality of dividing walls and a plurality of receiving passageways defined between said dividing walls; and a plurality of power contacts received in said corresponding receiving passageways, respectively;

wherein at least one of said dividing walls defines a heat dissipation cutout therealong;

wherein said insulating housing defines a plurality of opening arranged side by side between every two adjacent receiving passageways, and wherein said opening communicate with said heat dissipation cutouts, respectively.

2. The electrical connector as claimed in claim 1, wherein said heat dissipation cutout has a U-shaped cross-section.

3. The electrical connector as claimed in claim 1, wherein said insulating housing comprises a main section and a mating section extending forwardly from said main section, and wherein said mating section has a mating surface formed in the front thereof, from which said heat dissipation cutout is recessed therefrom.

4. The electrical connector as claimed in claim 3, wherein said insulating housing forms a pair of guiding posts on said main section and positioned at opposite sides of said mating section.

5. The electrical connector as claimed in claim 1, wherein said plurality of power contacts are grouped by pairs, and wherein each power contact comprises a base portion, a contacting portion extending from said base portion and a bent portion connecting said contacting portion and said base portion, and wherein each pair of power contacts is arranged in minor symmetry.

6. The electrical connector as claimed in claim 5, wherein each pair of power contact has two tabs protruding from respective base portions thereof and extending towards each other, and wherein said base portion defines a barb along at least one side edge thereof.

7. The electrical connector as claimed in claim 6, wherein said insulating housing provides a back wall in each receiving passageway, and wherein a pair of back slits is defined through said back wall, which communicates with corresponding receiving passageway.

8. The electrical connector as claimed in claim 7, wherein each of said back wall defines a pair of recesses for engaging with said tabs of each pair of power contacts, and wherein said tab extends along a front-to-back direction.

9. The electrical connector as claimed in claim 1, further comprising a plurality of signal contacts received in said insulating housing.

10. The electrical connector as claimed in claim 9, wherein each of said signal contacts comprises a retaining portion, a contacting end extending from said retaining portion, a tail portion extending from said retaining portion opposite to said contacting end, and a bent portion connecting said retaining portion and said tail portion.

11. The electrical connector as claimed in claim 10, further comprising a spacer for organizing and securing said tail portions of said signal contacts.

12. The electrical connector as claimed in claim 11, wherein said signal contacts are divided into different groups.

13. The electrical connector as claimed in claim 12, wherein said bent portions of different groups of said signal contacts are arranged in different rows.

* * * * *